US005819708A

United States Patent [19]

Buratti et al.

[11] Patent Number: 5,819,708

[45] Date of Patent: Oct. 13, 1998

[54] FUEL RETAINING AND COLLECTING STRUCTURE FOR AN INTERNAL COMBUSTION ENGINE HIGH-PRESSURE INJECTION SYSTEM

[75] Inventors: Riccardo Buratti, Genoa; Giovanni Maria Rossi Sebastiano, Turin, both of Italy

[73] Assignee: C.R.F. Societa Consortile Per Azioni, Turin, Italy

[21] Appl. No.: 792,918

[22] Filed: Jan. 21, 1997

[30] Foreign Application Priority Data

Jan. 23, 1996 [IT] Italy ..... TO96A0036

[51] Int. Cl.[6] ..... F02M 37/04

[52] U.S. Cl. ..... 123/468; 123/470; 285/13; 137/312

[58] Field of Search ..... 123/468, 470, 123/472, 456, 198 D; 165/70; 137/312; 285/13, 14, 93

[56] References Cited

U.S. PATENT DOCUMENTS

| | | | |
|---|---|---|---|
| 2,447,185 | 8/1948 | Keim | 285/13 |
| 2,903,495 | 9/1959 | Dickson | 165/70 |
| 3,845,748 | 11/1974 | Eisenberg | 123/468 |
| 3,924,583 | 12/1975 | Jardin | 123/470 |
| 4,149,568 | 4/1979 | Kuntz et al. | 138/114 |
| 4,295,452 | 10/1981 | Lemdke | 123/469 |
| 4,467,610 | 8/1984 | Pearson | 285/13 |
| 4,485,790 | 12/1984 | Nishimura | 123/468 |
| 4,722,708 | 2/1988 | Baltz | 123/468 |
| 4,784,104 | 11/1988 | Dimond | 123/468 |
| 4,836,237 | 6/1989 | McCullough | 137/312 |
| 5,239,964 | 8/1993 | Diener | 123/456 |
| 5,277,455 | 1/1994 | Graves | 285/93 |
| 5,365,907 | 11/1994 | Dietrich | 285/13 |
| 5,404,905 | 4/1995 | Lauria | 137/312 |
| 5,476,080 | 12/1995 | Brunnhofer | 123/198 D |

FOREIGN PATENT DOCUMENTS

| | | | |
|---|---|---|---|
| 462273 | 6/1928 | Germany . | |
| 1809619 | 6/1970 | Germany . | |
| 2938687 | 4/1981 | Germany . | |
| 59-153966 | 9/1984 | Japan . | |
| 804592 | 11/1958 | United Kingdom | 165/70 |

OTHER PUBLICATIONS

Patent Abstracts of Japan of JP 59153966 of Sep. 1984.

*Primary Examiner*—Carl S. Miller
*Attorney, Agent, or Firm*—Ladas & Parry

[57] ABSTRACT

The structure has a number of sleeves fitted about the conduits of a supply circuit supplying fuel to the injectors of an engine. Each sleeve is tubular, and has a bellows type main body, two opposite end portions, and an outlet fitting extending from one of the end portions. The sleeves are fitted to the conduits by fitting the end portions in fluidtight manner to fittings at opposite ends of the conduits. The outlet fitting of each sleeve is then connected to a catch header by a respective connecting line, which connects the inner cavity of the main body to the catch header to enable any fuel leakage from the conduits to flow into the catch header.

14 Claims, 2 Drawing Sheets

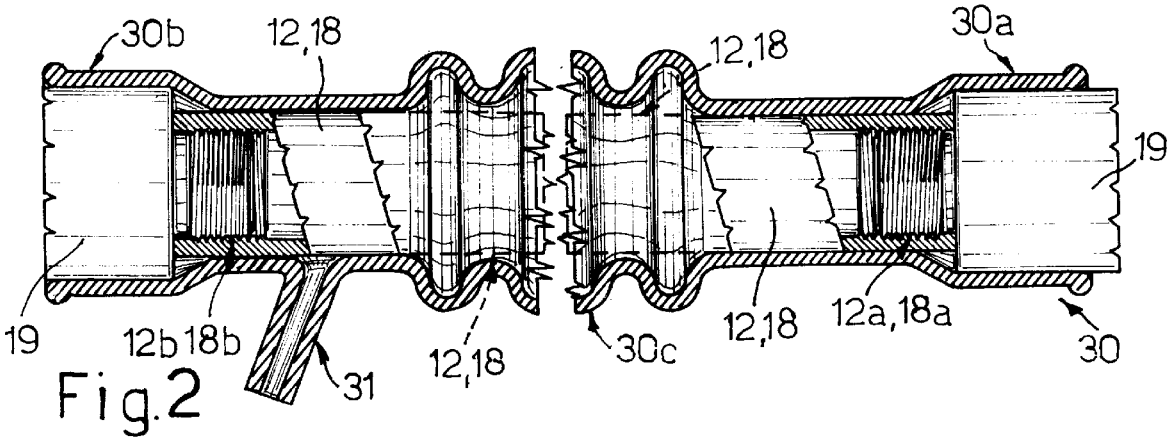
Fig.2
Fig.3
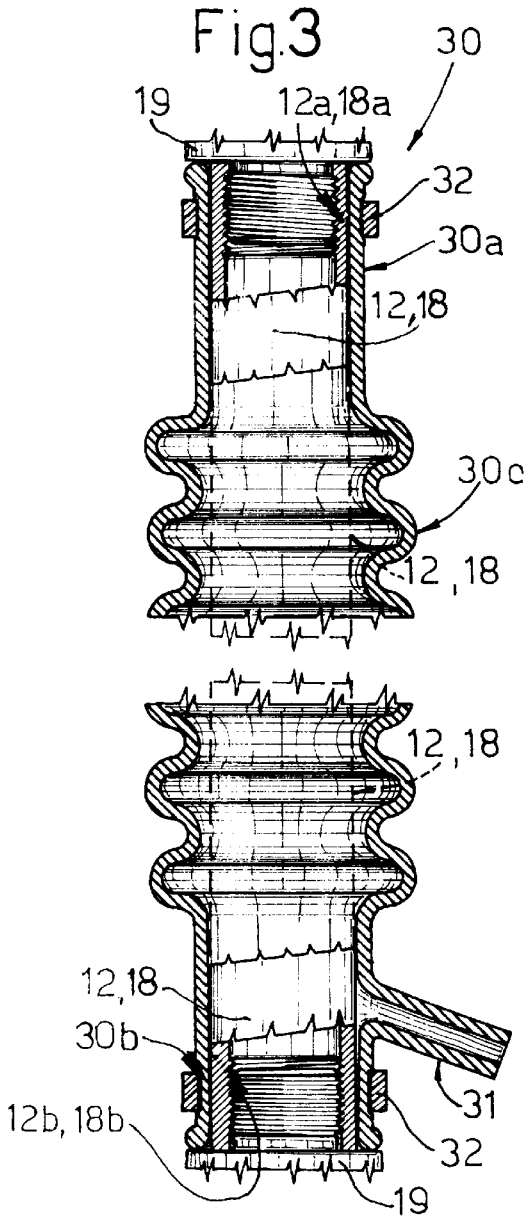
Fig.4
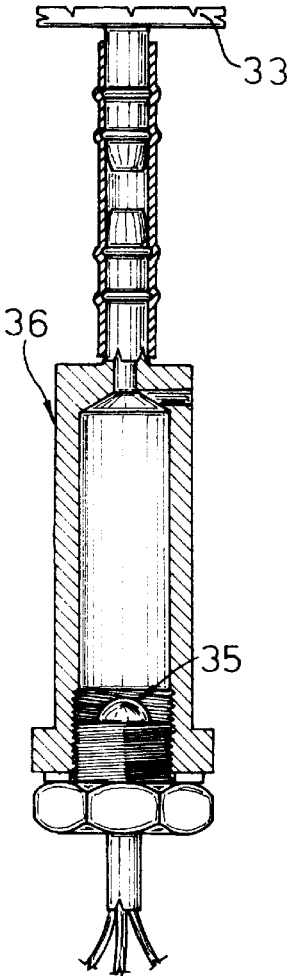

FUEL RETAINING AND COLLECTING STRUCTURE FOR AN INTERNAL COMBUSTION ENGINE HIGH-PRESSURE INJECTION SYSTEM

BACKGROUND OF THE INVENTION

The present invention relates to a fuel retaining and collecting structure for an internal combustion engine high-pressure injection system.

As is known, high-pressure injection systems comprise a high-pressure supply circuit by which fuel is fed to a number of injectors supplying the engine.

One problem of such systems is that any leakage of the fuel supply circuit, e.g. through minute cracks in the high-pressure conduits, results in the escape of atomized fuel which may prove inflammable in contact with the high temperature of the engine.

Which problem is further compounded by the escaping fuel being pollutant and giving rise to excessive fuel consumption.

SUMMARY OF THE INVENTION

It is an object of the present invention to provide a fuel retaining and collecting structure for retaining any fuel leakage from the high-pressure supply circuit.

Advantageously, the present structure must be capable of diagnosing the presence of such leakage.

According to the present invention, there is provided a fuel retaining and collecting structure for a high-pressure injection system of an internal combustion engine, said injection system comprising a number of injectors supplied by respective conduits along which high-pressure fuel flows in use; characterized by comprising sleeves surrounding said conduits to retain any fuel escaping from the conduits; and a catch header connected to said sleeves and for receiving the fuel contained in said sleeves.

BRIEF DESCRIPTION OF THE DRAWINGS

A preferred, non-limiting embodiment of the present invention will be described by way of example with reference to the accompanying drawings, in which:

FIG. 2 shows a longitudinal section of a detail of the structure according to the invention, fitted in one manner to the FIG. 1 injection system;

FIG. 3 shows a longitudinal section of the FIG. 2 detail fitted in an alternative manner to the injection system;

FIG. 4 shows a detailed cross section of a component part of the present structure.

DETAILED DESCRIPTION OF THE INVENTION

Figure 1:
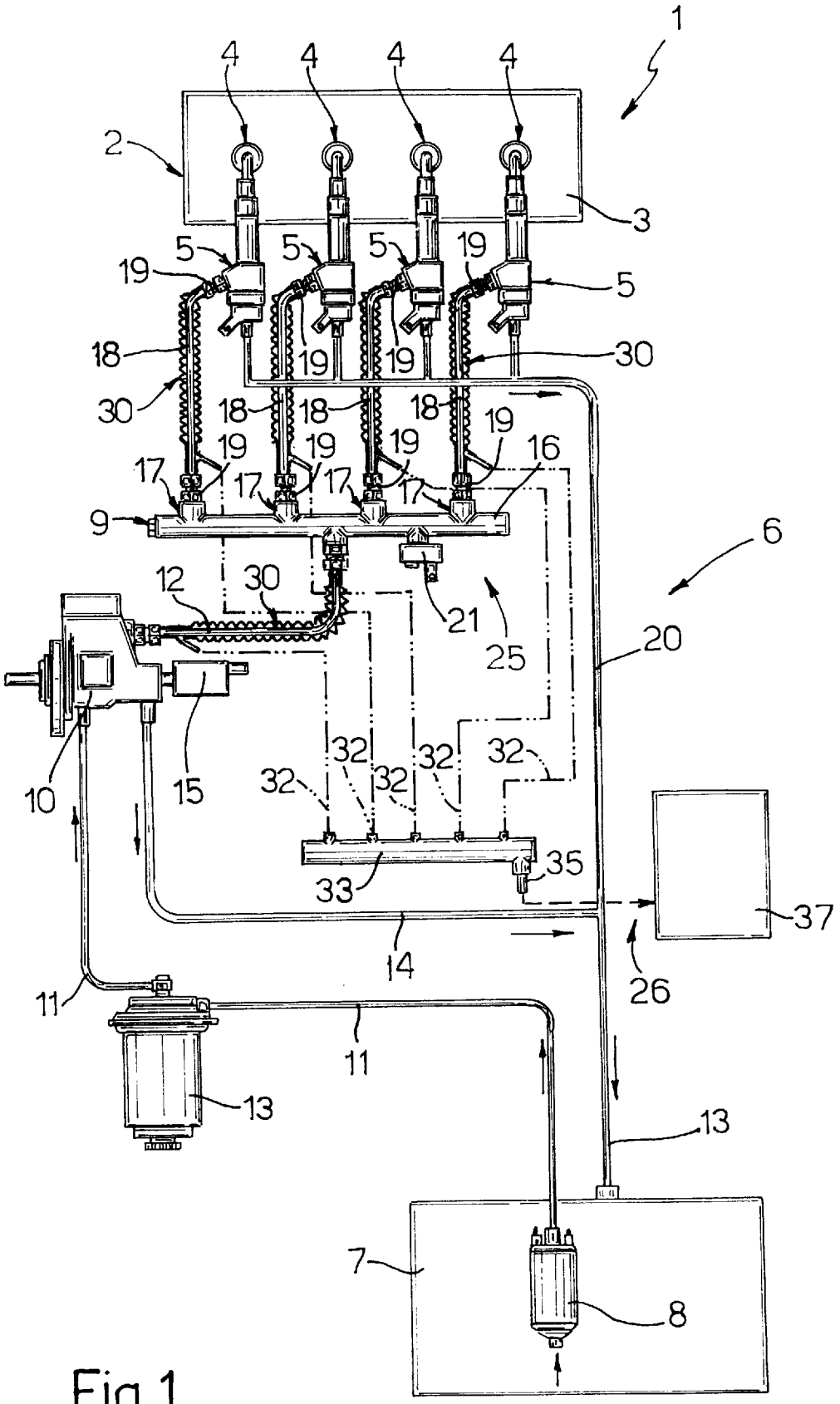
FIG. 1 shows a simplified diagram of a high-pressure injection system fitted with the structure according to the present invention.

Number 1 in FIG. 1 indicates a high-pressure injection system for an internal combustion engine 2 comprising a block 3 and cylinders 4.

Injection system 1 comprises a number of injectors 5 for supplying fuel to cylinders 4 of engine 2, and in turn supplied by a known "common rail" supply circuit 6.

Supply circuit 6 comprises a fuel tank 7; a fuel delivery pump 8 housed inside tank 7; a known common rail 9; a radial-piston pump 10 connected to delivery pump 8 by a low-pressure delivery line 11, and to common rail 9 by a high-pressure delivery line 12; and a fuel filter 13 located along low-pressure delivery line 11.

Radial-piston pump 10 is also connected to fuel tank 7 by a drain line 14 for feeding back into tank 7 part of the fuel used to cool and lubricate the pump.

Radial-piston pump 10 comprises a pressure regulating solenoid valve 15, which receives part of the fuel supplied by pump 10 to common rail 9 to control the pressure in common rail 9 in known manner and therefore not described in detail.

Common rail 9 comprises a substantially parallelepiped body 16 in which is formed a cylindrical cavity (not shown) extending the full length of common rail 9 and connected to high-pressure delivery line 12.

Common rail 9 also comprises unions 17 located along the whole of body 16 and connected to injectors 5 by respective high-pressure supply conduits 18.

Each supply conduit 18 and the high-pressure delivery line 12 also comprise fittings 19 located at respective opposite ends 18*a*, 18*b* and 12*a*, 12*b* (see FIG. 2).

Each injector 5 is connected to drain line 14 by a recirculating conduit 20 to feed back into tank 7 that part of the fuel supply to injector 5 used to operate a drive valve (not shown) of injector 5.

Common rail 9 is also connected to a pressure sensor 21 operating in known manner and therefore not described in detail.

As shown in FIG. 1, injection system 1 also comprises a retaining and collecting structure 25 connected to a unit 26 for detecting leakage of injection system 1.

Retaining and collecting structure 25 comprises a number of sleeves 30 preferably made of rubber or elastomeric material, and fitted to each high-pressure supply conduit 18 and to high-pressure delivery line 12.

More specifically, and as shown in detail in FIG. 2, each sleeve 30 is tubular, and comprises a bellows type main body 30*c*, two opposite end portions 30*a*, 30*b*, and an outlet fitting 31 extending from one of end portions 30*a*, 30*b*.

Sleeves 30 are fitted to supply conduits 18 and to high-pressure delivery line 12 by fitting end portions 30*a*, 30*b* in fluidtight manner to fittings 19.

Alternatively, as shown in FIG. 3, sleeves 30 may be fitted to supply conduits 18 and to high-pressure delivery line 12 by fitting end portions 30*a*, 30*b*, in fluidtight manner by means of clamps 32, to respective end portions 18*a*, 18*b* of each supply conduit 18, and to respective end portions 12*a*, 12*b* of high-pressure delivery line 12.

Main body 30*c* is flexible and deformable to adapt the shape and length of sleeves 30 to the shape and length of each supply conduit 18 and of high-pressure delivery line 12.

The outlet fitting 31 of each sleeve 30 is connected to a catch header 33 by a respective connecting line 32 (FIG. 1), which connects the inner cavity of main body 30*c* to catch header 33 to enable any fuel escaping from high-pressure delivery line 12 and from supply conduits 18 to flow into catch header 33.

When assembling the engine, sleeves 30 are first fitted to supply conduits 18 and to high-pressure delivery line 12 before these are connected to supply circuit 6.

Conduits 18 and line 12 are then screwed to the other components of supply circuit 6, and sleeves 30 are pulled to adapt their length to the length of conduits 18 and line 12.

Each end portion 30*a*, 30*b* is the n fitted in fluidtight manner to fittings 19 of supply conduits 18 and high-pressure delivery line 12, or is fitted to respective end portions 18*a*, 18*b*, 12*a*, 12*b* of supply conduits 18 and high-pressure delivery line 12 and made fluidtight by means of clamps 32.

Leakage detecting unit 26 comprises a fluid sensor 35 and an electronic central control unit 37.

Fluid sensor 35 (FIG. 4) is housed inside a fitting 36 fitted to the bottom of and beneath catch header 33 so that any fuel in catch header 33 comes into contact with fluid sensor 35.

Fluid sensor 35 generates a leakage signal L indicating the presence of fuel inside catch header 33, and is preferably a commercial solid-state optical level sensor having a different reflectivity in the presence and absence of fluid.

Electronic central control unit 37 (e.g. the injection central control unit of system 1) receives leakage signal L and generates an alarm signal S, which is supplied to a display (not shown, and located for example on the vehicle instrument panel) upon the sensor detecting the presence of fuel in catch header 33.

In actual use, any fuel leakage from supply conduits 18 and high-pressure delivery line 12 is retained by sleeves 30 and fed into catch header 33 along outlet fittings 31 and connecting lines 32.

Fluid sensor 35 detects the presence of fuel in header 33, and generates leakage signal L, which may, for example, be a digital signal normally assuming a low logic value, and which switches to a high logic value upon fuel being detected.

Central control unit 37 is thus able to generate a corresponding signal to inform the driver of the presence of fuel in catch header 33.

The advantages of the present structure are as follows.

In particular, sleeves 30 fitted to supply conduits 18 and high-pressure delivery line 12 prevent any fuel leakage through cracks in conduits 18 or line 12 from being dispersed and so causing pollution and possibly catching fire.

Moreover, the driver is informed immediately of any cracks or failure of the supply system, and may thus provide for immediate repair.

Finally, the fuel leakage detecting unit is easy to produce by requiring no more than a known fluid sensor, the operations required being performed directly by the electronic injection control unit.

Clearly, changes may be made to the structure as described and illustrated herein without, however, departing from the scope of the present invention.

We claim:

1. A fuel retaining and collecting structure (25) for a high-pressure injection system (1) of an internal combustion engine (2), said injection system (1) comprising a number of injectors (5) suppled by respective conduits (12, 18) along which high-pressure fuel flows in use, said fuel retaining and collecting structure comprising:

sleeves (30) distinct from said internal combustion engine (2) and surrounding said conduits (12, 18) to retain any fuel escaping from the conduits (12, 18), said conduits being external to said internal combustion engine (2); and a catch header (33) external to said internal combustion engine (2) and connected to said sleeves (3), said catch header (33) for receiving the fuel contained in said sleeves (30)

wherein each of said sleeves (30) is substantially tubular and comprises a main body (30*c*), two opposite end portions (30*a*, 30*b*) fitted in fluidtight manner to respective opposite end portions (12*a*, 12*b*, 18*a*, 18*b*) of said conduits (12, 18), and an outlet fitting (31) extending from one of the end portions (30*a*, 30*b*) of said sleeve (30), and said main body (30*c*) is in the form of a bellows and is elastically deformable.

2. A structure as claimed in claim 1, characterized in that said sleeves (30) are made of elastomeric material.

3. A structure as claimed in claim 1, characterized by comprising a fluid sensor (35) located beneath said catch header (33) and for generating a leakage signal (L) indicating the presence of fuel inside said catch header (33); and alarm signal generating means (37) for generating an alarm signal (S) on receiving said leakage signal (L).

4. A structure as claimed in claim 3, characterized in that said fluid sensor (35) is an optical solid-state sensor.

5. A fuel retaining and collecting structure (25) for a high-pressure injection system (1) of an internal combustion engine (2), said injection system (1) comprising a number of injectors (5) supplied by respective conduits (12, 18) along which high-pressure fuel flows in use; said structure comprising:

sleeves (30) surrounding said conduits (12, 18) to retain any fuel escaping from the conduits (12, 18), each of said sleeves (3) being substantially tubular and having a main body (30*c*), two opposite end portions (30*a*, 30*b*), and an outlet fitting (31), said main body (30*c*) being in the form of an elastically deformable bellows, said two opposite end portions (30*a*, 30*b*) being fitted in a fluidtight manner to respective opposite end portions (12*a*, 12*b*, 18*a*, 18*b*) of said conduits (12, 18), and said outlet fitting (31) extending from one of the end portions (30*a*, 30*b*) of said sleeve (30); and a catch header (33) connected to said sleeves (30) and for receiving the fuel contained in said sleeves (30), each of said outlet fittings (31) being connected to said catch header (33) by a respective connecting line (32).

6. A structure as claimed in claim 5, wherein said sleeves (30) are made of elastomeric material.

7. A structure as claimed in claim 5, further comprising a fluid sensor (35) coupled to said catch header (33) and for generating a leakage signal (L) indicating the presence of fuel inside said catch header (33), and alarm signal generating means (37) for generating an alarm signal (S) in response to said leakage signal (L).

8. A structure as claimed in claim 7, wherein said fluid sensor (35) is an optical solid-state sensor.

9. A fuel retaining and collecting structure comprising:

sleeves for surrounding respective conduits of a fuel infection system of a combustion engine, said conduits being external to said combustion engine and for supplying fuel to said combustion engine said sleeves being distinct from said combustion engine and retaining any fuel emanating from said conduits; and a catch header for connection to each of said sleeves and receiving said fuel retained by said sleeves, said catch header being distinct from said combustion engine, wherein each of said sleeves is substantially tubular and comprises a main body, two opposite end portions fitted in a fluidtight manner to respective opposite end portions of said conduits and an outlet fitting extending from one of the end portions of said sleeve, and wherein said main body is in the form of a bellows and is elastically deformable.

10. A collecting structure according to claim 9, wherein each of said sleeves is made of elastomeric material.

11. A collecting structure according to claim 9, further comprising a fluid sensor coupled to said catch header and for generating a leakage signal indicating presence of fuel in said catch header, and alarm signal generating means for generating an alarm signal in response to said leakage signal.

12. A collecting structure according to claim 11, wherein said fluid sensor is an optical solid-state sensor.

13. A structure as claimed in claim 4, characterized in that each of said outlet fittings (31) is connected to said catch header (33) by a respective connecting line (32).

14. A collecting structure according to claim 9, wherein each of said outlet fittings is connected to said catch header by a respective connecting line.

* * * * *